US008207684B2

(12) United States Patent
Rudolph

(10) Patent No.: US 8,207,684 B2
(45) Date of Patent: Jun. 26, 2012

(54) BUCK CONVERTER AND METHOD FOR PROVIDING A CURRENT FOR AT LEAST ONE LED

(75) Inventor: Bernd Rudolph, Forstern (DE)

(73) Assignee: Osram AG, Munich (DE)

( * ) Notice: Subject to any disclaimer, the term of this patent is extended or adjusted under 35 U.S.C. 154(b) by 202 days.

(21) Appl. No.: 12/812,962

(22) PCT Filed: Jan. 17, 2008

(86) PCT No.: PCT/EP2008/050511

§ 371 (c)(1),
(2), (4) Date: Jul. 15, 2010

(87) PCT Pub. No.: WO2009/089912

PCT Pub. Date: Jul. 23, 2009

(65) Prior Publication Data

US 2011/0050130 A1 Mar. 3, 2011

(51) Int. Cl.
*H05B 41/36* (2006.01)
*H02M 3/335* (2006.01)

(52) U.S. Cl. ..... 315/297; 315/291; 315/187; 315/307; 315/247; 363/21.12; 363/21.13; 363/21.18

(58) Field of Classification Search ..... 315/297, 315/223, 307, 187, 186, 294, 224, 291, 234, 315/209 R, 185 S; 363/21.12, 21.09, 21.13, 363/21.18, 21.05, 18

See application file for complete search history.

(56) References Cited

U.S. PATENT DOCUMENTS

| | | | | |
|---|---|---|---|---|
| 7,569,996 | B2 * | 8/2009 | Holmes et al. | 315/291 |
| 7,708,447 | B2 | 5/2010 | Tobler et al. | |
| 7,893,744 | B2 * | 2/2011 | Nakamura et al. | 327/175 |
| 7,973,580 | B2 * | 7/2011 | Nakamura et al. | 327/172 |
| 2004/0189271 | A1 * | 9/2004 | Hansson et al. | 323/283 |
| 2005/0068459 | A1 * | 3/2005 | Holmes et al. | 348/372 |
| 2006/0043911 | A1 * | 3/2006 | Shao et al. | 315/291 |
| 2007/0013323 | A1 | 1/2007 | De Oto | |
| 2009/0013323 | A1 * | 1/2009 | May et al. | 718/104 |
| 2009/0072755 | A1 * | 3/2009 | Prexl et al. | 315/291 |
| 2009/0231552 | A1 * | 9/2009 | Huber et al. | 353/85 |
| 2010/0039080 | A1 * | 2/2010 | Schoenbauer et al. | 323/234 |
| 2010/0253302 | A1 * | 10/2010 | Otte et al. | 323/282 |

FOREIGN PATENT DOCUMENTS

| | | | |
|---|---|---|---|
| WO | 2004006629 | A2 | 1/2004 |
| WO | 2008001246 | A1 | 1/2008 |

OTHER PUBLICATIONS

English translation of International Search Report of PCT/EP2008/050511 mailed Dec. 2, 2008.

* cited by examiner

*Primary Examiner* — Vibol Tan

(57) ABSTRACT

A Buck converter may include an input for connecting a DC voltage source; an output for connecting an LED; and a diode, an inductor and a main switch; wherein the diode and the main switch are coupled in series, wherein the inductor is coupled between the connecting point for the diode and the main switch, and a first output connection, wherein the converter further includes: a first auxiliary switch supplied with a first voltage; and a second auxiliary switch supplied with a second voltage, wherein the first auxiliary switch and the second auxiliary switch are coupled to the main switch such that the first voltage stipulates the switch-off time for the main switch and the second voltage stipulates the switch-on time for the main switch.

17 Claims, 1 Drawing Sheet

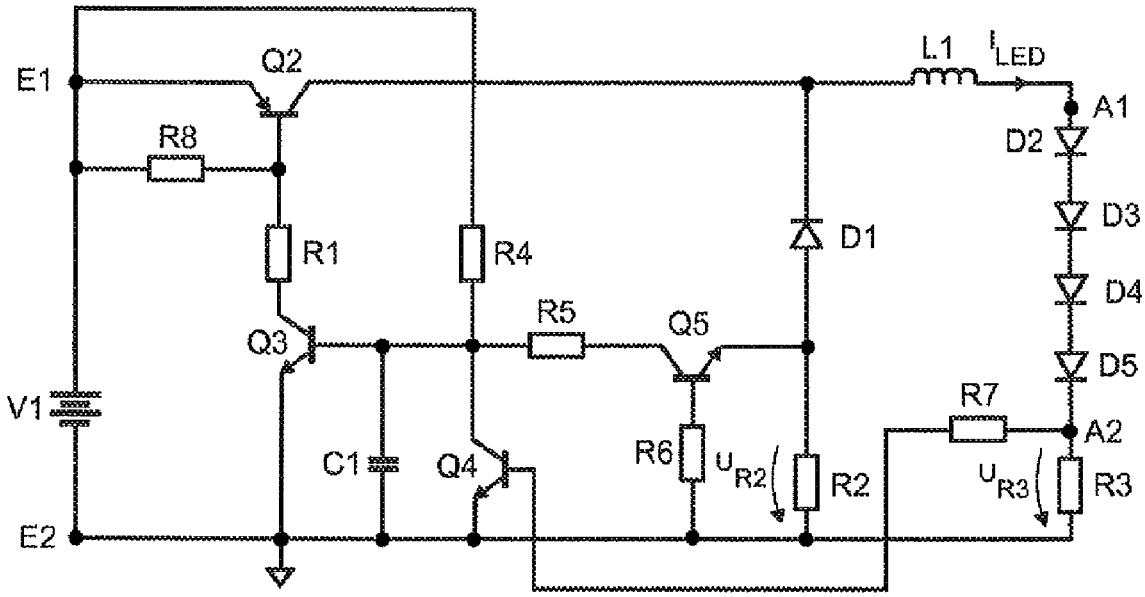
E1
Q2
R8
R1
Q3
V1
E2
C1
R4
Q4
R5
Q5
R6
$U_{R2}$
R2
D1
L.1
$I_{LED}$
A1
D2
D3
D4
D5
R7
A2
$U_{R3}$
R3

BUCK CONVERTER AND METHOD FOR PROVIDING A CURRENT FOR AT LEAST ONE LED

RELATED APPLICATIONS

The present application is a national stage entry according to 35 U.S.C. §371 of PCT application No.: PCT/EP2008/050511 filed on Jan. 17, 2008.

TECHNICAL FIELD

Various embodiments relate to a Buck converter for providing a current for at least one LED having an input with a first input connection and a second input connection for connecting a DC voltage source, an output with a first output connection and a second output connection for connecting the at least one LED, and the Buck diode, a Buck inductor and a Buck main switch, which has a control electrode, a working electrode and a reference electrode. Furthermore, various embodiments relate to an appropriate method for providing a current for at least one LED using a Buck converter.

BACKGROUND

With the advance of LEDs into broad areas of general lighting, there is a great need for simple and inexpensive power supply circuits for these components. There are now a large number of, in particular, integrated circuits which have been designed for such demands. Merely by way of example, the LM3402 chips from the National company and the LT3474 chip from the Linear Technology company may be mentioned in this context. However, such integrated circuits are frequently too expensive for use in mass products. There is therefore a need for the most inexpensive power supply circuit possible for at least one LED.

SUMMARY

Various embodiments provide a Buck converter such that it can be used as the most inexpensive power supply circuit possible for at least one LED. Furthermore, various embodiments provide a suitable method for providing a current for at least one LED using a Buck converter.

The present invention is based on the insight that these objects can be achieved when a Buck converter is designed as a two-position controller for the current which is to be provided for the at least one LED. In particular, the Buck converter needs to be designed such that it becomes possible to determine the switch-on and switch-off times of the Buck main switch in each case only by virtue of the base/emitter forward voltage of a small-signal bipolar transistor. This allows adjustment of the maximum value and the minimum value of the current through the at least one LED and hence the mean value and ripple of said current. On the basis of the preferred operation of a Buck converter according to the invention from a low-voltage DC voltage source, the Buck converter can be operated in continuous mode, i.e. the minimum value of the current provided for the at least one LED is not equal to zero.

As a particularly inexpensive measure, any further active switches required are likewise in the form of bipolar transistors.

In the implementation according to the invention, the first auxiliary switch accordingly stipulates the maximum value of the current provided for the at least one LED, and the second auxiliary switch stipulates the minimum value of said current.

These measures allow an extremely simple and inexpensive power supply circuit to be implemented for at least one LED. The use of bipolar transistors for the electronic switches gives rise to implementation costs and a space requirement which are below the corresponding comparison variables for an implementation by means of an integrated circuit.

Although the present invention is illustrated below using the example of supply from a low-voltage DC voltage source, for example a battery, it can readily be supplied from a mains voltage (100 to 230 V) by connecting an appropriate rectifying element upstream, provided that at least the transistors coupled in parallel to the rectifier output are implemented by fixed-voltage transistors.

In line with one preferred embodiment, the first voltage and the second voltage are dimensioned such that in the freewheeling phase of the Buck converter the first auxiliary switch changes to the nonconducting state before the second auxiliary switch. This provides the opportunity for both the first voltage and the second voltage to be tapped off from nonreactive resistors which both carry the same current. The time when which auxiliary switch changes to the nonconducting state can thereby be adjusted in a particularly simple manner by dimensioning the associated nonreactive resistor from which the relevant voltage is tapped off.

Preferably, the first auxiliary switch and the second auxiliary switch each have a control electrode, a reference electrode and a working electrode, wherein the first voltage and the second voltage are coupled between the control electrode and the reference electrode of the respective auxiliary switch, wherein in the freewheeling phase of the Buck converter the second voltage is larger than the first voltage.

In line with one preferred embodiment, the Buck converter also includes a first shunt resistor and a second shunt resistor, wherein the voltage drop across the first shunt resistor is the first voltage and wherein the voltage drop across the second shunt resistor is the second voltage. As already mentioned, simple dimensioning of the shunt resistors allows stipulation of when the Buck main switch is switched on and off. As a result, the maximum and minimum values of the current provided for the at least one LED are stipulated in a simple manner.

Preferably, the first shunt resistor is arranged such that in the charging phase of the Buck converter it carries the current provided for the at least one LED. Since, in the charging phase of the Buck converter, there is still no current flowing in the branch which contains the Buck diode, such an arrangement of the first shunt resistor allows adjustment of the maximum value of the current provided for the at least one LED.

In this case, the first shunt resistor is preferably coupled between the second output connection and a reference potential. As a result, the first voltage is referenced to the reference potential and allows particularly simple coupling to the first auxiliary transistor, provided that the reference electrode thereof is likewise coupled to the reference potential.

Preferably, the second shunt resistor is arranged such that in the freewheeling phase, but not in the charging phase, of the Buck converter it carries the current provided for the at least one LED. This allows the voltage drops across the two shunt resistors, particularly in the freewheeling phase of the Buck converter, to be linked to one another. The activation of the first auxiliary switch for the purpose of terminating the charging phase of the Buck converter is therefore uninfluenced by the second voltage.

Preferably, the second shunt resistor is coupled between the Buck diode and a reference potential. In this case too, the advantage arises that the second voltage can be coupled to the second auxiliary transistor particularly easily if said second auxiliary transistor is likewise coupled to the reference potential.

So that the first and second voltages can be tapped off directly from the relevant shunt resistors and can be coupled to the relevant auxiliary switches, the first shunt resistor is preferably smaller than the second shunt resistor. This means that both can carry the same current and there is nevertheless the assurance that the second voltage is larger than the first voltage in the freewheeling phase of the Buck converter.

In one particularly inexpensive implementation, at least the first auxiliary switch and the second auxiliary switch are in the form of bipolar transistors, wherein the voltage drop across the first shunt resistor is coupled as a base/emitter voltage to the first auxiliary switch, and the voltage drop across the second shunt resistor is coupled as an emitter/base voltage to the second auxiliary switch.

In line with one preferred development, the Buck converter includes a third auxiliary switch which has a control electrode, a working electrode and a reference electrode, wherein the reference electrode of the third auxiliary switch is coupled to a reference potential, wherein the working electrode of the third auxiliary switch is coupled to the control electrode of the Buck main switch, wherein the control electrode of the third auxiliary switch is coupled to the first auxiliary switch and to the second auxiliary switch. As a result of this measure, the first and second auxiliary switches actuate the third auxiliary switch in parallel, said third auxiliary switch in turn controlling the Buck main switch. In this case, it is particularly preferred if the first auxiliary switch and the second auxiliary switch each have a control electrode, a working electrode and a reference electrode, wherein the working electrode-reference electrode path of the first auxiliary switch and the working electrode-control electrode path of the second auxiliary switch are coupled in parallel to the control path, i.e. the control electrode-reference electrode path, of the third auxiliary switch. This provides the opportunity for the first auxiliary switch to be operated as an emitter circuit and for the second auxiliary switch to be operated as a base circuit. In this case, the reference and control electrodes of the first auxiliary switch have the voltage drop across the first shunt resistor coupled between them, and the control and reference electrodes of the second auxiliary switch have the voltage drop across the second shunt resistor coupled between them.

Particularly preferably, the control electrode of the third auxiliary switch is coupled to the first input connection via a nonreactive resistor. This ensures that the third auxiliary switch switches on the Buck main switch, in order to allow the Buck converter according to the invention to start up, when a DC supply voltage is applied to the input of the Buck converter.

Preferably, the control electrode and the reference electrode of the third auxiliary switch have a capacitor coupled between them. This is used to keep down the base potential of the third auxiliary switch when the conducting states change from the first auxiliary switch to the third auxiliary switch (influence of the switching times of the Buck diode, of the first auxiliary switch and of the second auxiliary switch), such that the third auxiliary switch and hence the Buck main switch remain safely off during the demagnetization of the Buck inductor to the desired minimum current.

Finally, it is preferred if the control electrode of the Buck main switch is coupled to the first input connection via a nonreactive resistor. This speeds up the clearance of the base of the Buck main switch, provided that the latter is in the form of a bipolar transistor.

The following detailed description refers to the accompanying drawings that show, by way of illustration, specific details and embodiments in which the invention may be practiced.

The preferred embodiments presented with reference to the Buck converter according to the invention and the advantages of said embodiments are valid, where applicable, for the method according to the invention in corresponding fashion.

BRIEF DESCRIPTION OF THE DRAWING(S)

An exemplary embodiment of a Buck converter according to the invention will now be illustrated in more detail below with reference to the appended drawing, which shows a schematic illustration of an exemplary embodiment of a converter according to the invention.

DETAILED DESCRIPTION

FIG. 1 shows a schematic illustration of an exemplary embodiment of a Buck converter according to the invention. This has an input with a first input connection E1 and a second input connection E2, between which a low-voltage DC voltage source V1 at, in the present case, 9 V is coupled. The input connection E2 is coupled to a reference potential. The first input connection E1 and the second input connection E2 have the series circuit comprising a Buck main switch Q2, a Buck diode D1 and a nonreactive resistor R2 coupled between them. The connecting point for the Buck main switch Q2 and the Buck diode D1, on the one hand, and a first output connection A1 have a Buck inductor L1 coupled between them. The output connection A1 and a second output connection A2 have an LED, which in the circuit diagram is represented by the series circuit including D2, D3, D4 and D5, coupled between them. The output connection A2 and the reference potential have a non-reactive resistor R3 coupled between them. The voltage drop across the nonreactive resistor R3 is coupled via a nonreactive resistor R7 to the base of a first auxiliary switch Q4, the emitter of which is likewise coupled to the reference potential. The collector of the first auxiliary switch is coupled via a nonreactive resistor R4 to the first input connection E1. The Buck converter also has a second auxiliary switch Q5, the emitter of which is coupled to the connecting point between the Buck diode D1 and the nonreactive resistor R2. The base of the second auxiliary switch Q5 is coupled via a nonreactive resistor R6 likewise to the reference potential. The collector of the second auxiliary switch Q5 is coupled via a nonreactive resistor R5 to the connecting point between the nonreactive resistor R4 and the collector of the first auxiliary switch Q4. Said connecting point is coupled to the base of a third auxiliary switch Q3, the emitter of which is coupled to the reference potential. The collector of the third auxiliary switch Q3 is coupled via a nonreactive resistor R1 to the base of the Buck main switch Q2. The base of the third auxiliary switch Q3 and the reference potential have a capacitor C1 connected between them. The base of the Buck main switch Q2 and the first input connection have a nonreactive resistor R8 connected between them.

The functional principle is as follows: when a DC voltage source V1 has been applied between the first input connection E1 and the second input connection E2, the third auxiliary switch Q3 is switched to the conducting state via the nonreactive resistor R4. The current flowing from the collector to the emitter of the third auxiliary switch switches the Buck main switch Q2 to the conducting state via the nonreactive resistor R1. The charging phase of the Buck converter has begun. In this case, a current flows via the Buck main switch through the Buck inductor, the LEDs D2 to D5, via the nonreactive resistor R3 and the reference potential back to the output E2.

If the voltage drop across the nonreactive resistor R3 exceeds the base/emitter threshold voltage of the first auxiliary switch Q4 from approximately 0.6 V, the first auxiliary switch Q4 is switched to the conducting state. As a result, the base current previously provided for the third auxiliary switch Q3 via the nonreactive resistor R4 is routed via the first auxiliary switch Q4 to the reference potential. The third auxiliary switch Q3 changes as a result to the nonconducting state, which switches off the Buck main switch Q2 in consequence. The freewheeling phase of the Buck converter has begun. In the freewheeling phase, a current flows from the reference potential via the nonreactive resistor R2, the Buck diode D1, the Buck inductor L1 and the LEDs D2 to D5 and the nonreactive resistor R3 back to the reference potential. The voltage drop across the nonreactive resistor R2 switches the second auxiliary switch Q5 to the conducting state and thereby ensures that the third auxiliary switch Q3 and hence the Buck main switch Q2 remain safely switched off.

In the freewheeling phase of the Buck converter, the current $I_{LED}$ provided for the LEDs D2 to D5 decreases continually, but the chosen dimensioning means that the voltage drop across the nonreactive resistor R2 is always larger than the voltage drop across the nonreactive resistor R3. The result of this is that first of all the first auxiliary switch Q4 is switched to the nonconducting state. Since the second auxiliary switch Q5 is still in the conducting state, however, the third auxiliary switch Q3 and hence the Buck main switch Q2 remain switched off first of all. Only when the voltage drop across the nonreactive resistor R2 has fallen so far that the second auxiliary switch Q5 also changes to the nonconducting state can the current flowing via the nonreactive resistor R4 flow back to the base While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

Additionally, please cancel the originally-filed Abstract of the Disclosure, and add the accompanying new Abstract of the Disclosure which appears on a separate sheet in the Appendix. of the third auxiliary switch Q3, switch it on and hence switch on the Buck main switch Q2.

Accordingly, the upper limit value for the current $I_{LED}$ is determined as:

$$I_{LEDmax}=U_{BEF}(Q4)/R3$$

and the lower limit value of the LED current is determined as:

$$I_{LEDmin}=U_{BEF}(Q5)/R2.$$

The frequency of the triangular current $I_{LED}$ is determined by the input voltage V1, the voltage drop across the LEDs D2 to D5, the inductance of the Buck inductor L1 and the limit values for the minimum LED current $I_{LEDmin}$ and the maximum LED current $I_{LEDmax}$.

The invention claimed is:

1. A Buck converter for providing a current for at least one light emitting diode, the Buck converter comprising:

an input with a first input connection and a second input connection for connecting a DC voltage source;

an output with a first output connection and a second output connection for connecting the at least one light emitting diode; and a Buck diode, a Buck inductor and a Buck main switch, which has a control electrode, a working electrode and a reference electrode;

wherein the Buck diode and the Buck main switch are coupled in series between the first input connection and the second input connection, wherein the Buck inductor is coupled between the connecting point for the Buck diode and the Buck main switch, on the one hand, and the first output connection, on the other hand, wherein the Buck converter further comprises:

a first auxiliary switch which is supplied with a first voltage which is correlated to the current provided for the at least one light emitting diode; and a second auxiliary switch which is supplied with a second voltage which is correlated to the current provided for the at least one light emitting diode, wherein the first auxiliary switch and the second auxiliary switch are coupled to the Buck main switch such that the first voltage stipulates the switch-off time for the Buck main switch and the second voltage stipulates the switch-on time for the Buck main switch.

2. The Buck converter as claimed in claim 1, wherein the first voltage and the second voltage are dimensioned such that in the freewheeling phase of the Buck converter the first auxiliary switch changes to the nonconducting state before the second auxiliary switch.

3. The Buck converter as claimed in claim 1, wherein the first auxiliary switch and the second auxiliary switch each have a control electrode, a reference electrode and a working electrode, wherein the first voltage and the second voltage are coupled between the control electrode and the reference electrode of the respective auxiliary switch, wherein in the freewheeling phase of the Buck converter the second voltage is larger than the first voltage.

4. The Buck converter as claimed in claim 1, wherein the Buck converter further comprises:

a first shunt resistor, a second shunt resistor, wherein the voltage drop across the first shunt resistor is the first voltage and wherein the voltage drop across the second shunt resistor is the second voltage.

5. The Buck converter as claimed in claim 4, wherein the first shunt resistor is arranged such that in the charging phase of the Buck converter it carries the current provided for the at least one light emitting diode.

6. The Buck converter as claimed in claim 5, wherein the first shunt resistor is coupled between the second output connection and a reference potential.

7. The Buck converter as claimed in claim 1, wherein the second shunt resistor is arranged such that in the freewheeling phase, but not in the charging phase, of the Buck converter it carries the current provided for the at least one light emitting diode.

8. The Buck converter as claimed in claim 7, wherein the second shunt resistor is coupled between the Buck diode and a reference potential.

9. The Buck converter as claimed in claim 4, wherein the first shunt resistor is smaller than the second shunt resistor.

10. The Buck converter as claimed in claim 4, wherein the first auxiliary switch and the second auxiliary switch are in the form of bipolar transistors, wherein the voltage drop across the first shunt resistor is coupled as a base/emitter voltage to the first auxiliary switch, and the voltage drop across the second shunt resistor is coupled as an emitter/base voltage to the second auxiliary switch.

11. The Buck converter as claimed in claim 1, wherein the Buck converter comprises a third auxiliary switch which has a control electrode, a working electrode and a reference electrode, wherein the reference electrode of the third auxiliary switch is coupled to a reference potential, wherein the working electrode of the third auxiliary switch is coupled to the control electrode of the Buck main switch, wherein the control electrode of the third auxiliary switch is coupled to the first auxiliary switch and to the second auxiliary switch.

12. The Buck converter as claimed in claim 11, wherein the first auxiliary switch and the second auxiliary switch each have a control electrode, a working electrode and a reference electrode, wherein the working electrode—reference electrode path of the first auxiliary switch and the working electrode—control electrode path of the second auxiliary switch are coupled in parallel to the control path, i.e. the control electrode—reference electrode path, of the third auxiliary switch.

13. The Buck converter as claimed in claim 12, wherein the reference and control electrodes of the first auxiliary switch have the voltage drop across the first shunt resistor coupled between them, and in that the control and reference electrodes of the second auxiliary switch have the voltage drop across the second shunt resistor coupled between them.

14. The Buck converter as claimed in claim 11, wherein the control electrode of the third auxiliary switch is coupled to the first input connection via a nonreactive resistor.

15. The Buck converter as claimed in claim 11, wherein that the control electrode and the reference electrode of the third auxiliary switch have a capacitor coupled between them.

16. The Buck converter as claimed in claim 1, wherein the control electrode of the Buck main switch is coupled to the first input connection via a nonreactive resistor.

17. A method for providing a current for at least one light emitting diode using a Buck converter, the Buck converter comprising an input having a first input connection and a second input connection for connecting a DC voltage source; an output having a first output connection and a second output connection for connecting the at least one light emitting diode; a Buck diode, a Buck inductor and a Buck main switch, which has a control electrode, a working electrode and a reference electrode, wherein the Buck diode and the Buck main switch are coupled in series between the first input connection and the second input connection, wherein the Buck inductor is coupled between the connecting point for the Buck diode and the Buck main switch, on the one hand, and the first output connection, on the other hand, the method comprising:

a) providing a first auxiliary switch and a second auxiliary switch;

b) coupling the first auxiliary switch and the second auxiliary switch to the Buck main switch;

c) supplying a first voltage, which is correlated to the current provided for the at least one light emitting diode to the first auxiliary switch;

d) supplying a second voltage, which is correlated to the current provided for the at least one light emitting diode, to the second auxiliary switch;

wherein in step b) the first auxiliary switch and the second auxiliary switch are coupled to the Buck main switch such that the first voltage stipulates the switch-off time for the Buck main switch and the second voltage stipulates the switch-on time for the Buck main switch.

* * * * *

UNITED STATES PATENT AND TRADEMARK OFFICE

CERTIFICATE OF CORRECTION

PATENT NO. : 8,207,684 B2
APPLICATION NO. : 12/812962
DATED : June 26, 2012
INVENTOR(S) : Bernd Rudolph It is certified that error appears in the above-identified patent and that said Letters Patent is hereby corrected as shown below:

Column 5, Line 36, delete "While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced. Additionally, please cancel the originally-filed Abstract of the Disclosure, and add the accompanying new Abstract of the Disclosure which appears on a separate sheet in the Appendix."

Column 5, Line 50, insert --While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.--

Signed and Sealed this
Thirtieth Day of October, 2012

David J. Kappos

David J. Kappos
*Director of the United States Patent and Trademark Office*